US005111906A

United States Patent [19]

Abadia

[11] Patent Number: 5,111,906

[45] Date of Patent: May 12, 1992

[54] RETRACTABLE LADDER APPARATUS

[76] Inventor: Auguste Abadia, 2360 Greenfield, Los Angeles, Calif. 90064

[21] Appl. No.: 652,082

[22] Filed: Feb. 7, 1991

[51] Int. Cl.[5] ..... E06C 9/06

[52] U.S. Cl. ..... 182/19; 182/79; 182/163

[58] Field of Search ..... 182/77, 78, 79, 80, 182/19, 163

[56] References Cited

U.S. PATENT DOCUMENTS

| | | | |
|---|---|---|---|
| 897,870 | 9/1908 | Bessler | 182/79 |
| 1,636,279 | 7/1927 | Bessler | 182/80 |
| 1,636,280 | 7/1927 | Bessler | 182/80 |
| 1,636,281 | 7/1927 | Bessler | 182/80 |
| 1,749,409 | 3/1930 | Bessler | 182/80 |
| 1,805,829 | 5/1931 | Marschke | 182/78 |
| 1,811,707 | 6/1931 | Bessler | 182/80 |
| 1,858,981 | 5/1932 | Bessler | 182/80 |
| 1,930,992 | 10/1933 | Bessler | 182/80 |
| 2,931,456 | 4/1960 | Harmon | 182/80 |
| 3,789,955 | 2/1974 | Knapp | 182/78 |

FOREIGN PATENT DOCUMENTS

| | | | |
|---|---|---|---|
| 701738 | 1/1941 | Fed. Rep. of Germany | 182/78 |

*Primary Examiner*—Reinaldo P. Machado
*Attorney, Agent, or Firm*—Timothy T. Tyson

[57] ABSTRACT

A retractable ladder apparatus (30) for access between a lower and an upper floor is provided. A ladder (60) is moved by moving means, which may be a garage door opener (40), between a position of storage within the upper floor to a position where the lower end of the ladder abuts the lower floor.

19 Claims, 2 Drawing Sheets

RETRACTABLE LADDER APPARATUS

TECHNICAL FIELD

The present invention pertains to retractable access devices between floor, and more particularly, to retractable ladders.

BACKGROUND ART

There exists a need for access between floors of buildings where there is not room of the need for permanent access structure such as stairways, elevators or escalators. Examples of such a need are an attic in home, an overhead storage area in a garage, or an overhead storage loft in a warehouse. In these and other similar cases there is occasional need for access to an upper area but it is desirable for the access means to be out of the way most of the time so that the lower floor area can be used for other activities. Therefore a permanent structure is not an acceptable alternative. What is needed is an access means between floors that can be readily used but also readily stored out of the way when not in use.

Such temporary access between floors has been addressed in U.S. Pat. No. 1,930,992 to Bessler which has a stairway that rolls down a hinged access panel in the upper floor. The movement of the stairway is powered by an electric motor through a system of cables and pulleys.

In U.S. Pat. No. 2,931,456 to Harmon a system of gears, cables pulleys is used to move a stairway between floors but the stairway is guided by a pair of curved handrails that each pass between a pair of guide wheels. The shape of the handrails determine the motion profile of the stairway.

In U.S. Pat. No.3,789,955 to Knapp a stairway is moved through a rack and pinion by an electric motor and slides on a hinged ceiling panel.

Other material of background interest is in U.S. Pat. No. 1,636,279 to Bessler, U.S. Pat. No. 1,636,280 to Bessler, U.S. Pat. No. 1,636,281 to Bessler, U.S. Pat. No. 1,749,409 to Bessler, U.S. Pat. No. 1,811,707, U.S. Pat. No. 1,811,709 to Bessler, and U.S. Pat. No. 1,858,981 to Bessler.

DISCLOSURE OF INVENTION

The present invention is directed to a retractable ladder apparatus that provides access between a lower and an upper floor of a structure. Apparatus in accordance with the invention are characterized by a ladder and means to move it between a storage position substantially contained within the upper floor and a position abutting the lower floor from where it may be used for access between floors.

In a preferred embodiment the moving means comprises a garage door opener which moves a carrier in the form of a hook shaped member and the ladder is attached to the member by placing the upper rung of the ladder over the member. The angle of the garage door opener relative to the upper floor may be shallow because the ladder angle relative to the lower floor may be adjusted for access use. This allows installation of the retractible ladder apparatus in an upper floor where headroom is minimal. The ladder is supported by rollers for ease of movement. The ladder may be removed and used elsewhere.

In another preferred embodiment the ladder is articulated allowing it to bend as it is moved into the storage position and thereby again allowing installation of the retractible ladder apparatus in an upper floor where headroom is minimal.

The novel features of the invention are set forth with particularity in the appended claims. The invention will be best understood from the following description when read in conjunction with the accompanying drawings.

DESCRIPTION OF DRAWINGS

Incorporated as part of the description, in order to illustrate embodiments and principles of the present invention, are the accompanying drawings, wherein.

MODES FOR CARRYING OUT THE INVENTION

Figures 1, 2:
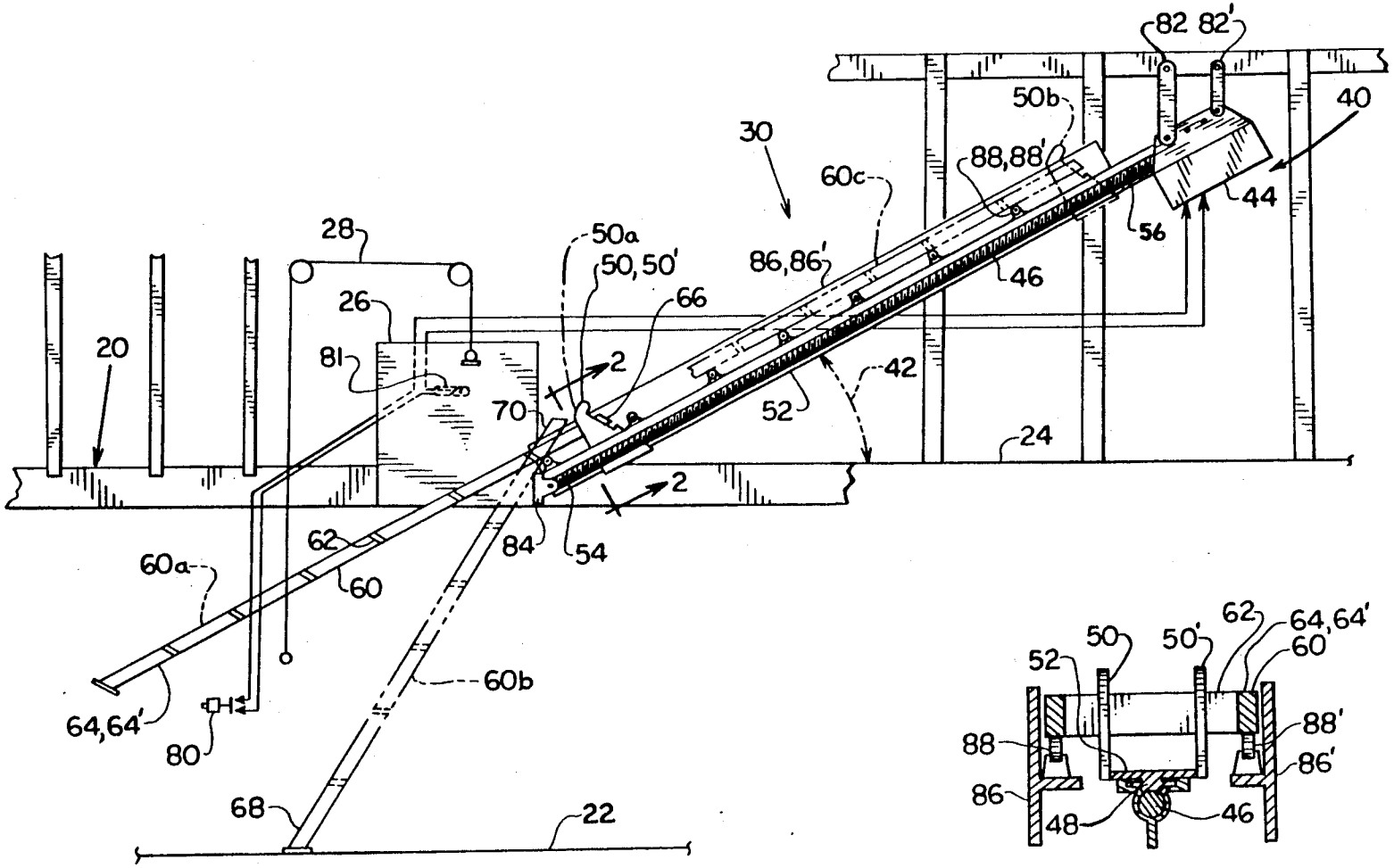
FIG. 1 is a sectional elevationa view, in accordance with an embodiment of the present invention, of a retractable ladder apparatus.
FIG. 2 is a sectional view along the line 1—1 of FIG. 1.

FIG. 1 is a sectional elevation view, in accordance with an embodiment of the present invention, of a retractable ladder apparatus 30. The ladder apparatus 30 is installed in a structure 20 to provide access between a lower floor 22 and an upper floor 24. In this embodiment, the apparatus 30 has a garage door opener 40 emplaced substantially above, and at an angle 42 with, the upper floor 24. The garage door opener 40 is of the type having a reversible electric motor means 44 turning a threaded rod 46. As shown in FIG. 2, which is a sectional view along the line 2—2 of FIG. 1, the threaded rod 46 turns within a threaded nut 48 to which a carrier such as a pair of hook shaped members 50, 50' are attached. The threaded nut 48 and threaded rod 46 are supported by a rail 52. The garage door opener 40 is mounted to the structure 20 by hangers 82, 82' at its upper end and a bracket 84 at its lower end. The hangers 82, 82' and the bracket 84 may be of any type well known in the garage door opener art.

Illustrated in FIGS. 1 and 2 is a conventional ladder 60 of the type having a plurality of rungs 62 between two sidepieces 64, 64'. The ladder 60 is mounted to the ladder apparatus 30 by placing the upper rung 66 over the hook shaped members 50, 50' as shown in position **60*a* of FIG. 1. The ladder 60 may be lifted from the hood shaped members 50, 50' and placed in position 60*b* with its lower end 68 abutting the lower floor 22 and its upper end 70 abutting the upper floor 24. In position 60*b* the ladder 60 is available for the uer to travel between the lower floor 22 and the upper floor 24**.

As seen in FIG. 2, the reversible motor means 44 turns the threaded rod 46 which causes the threaded nut 48, restrained from turning by the rail 50, to move along the rod 46. Thus the hook shaped members 50, 50' may be moved from position **50*a* at the lower end 54 of the threaded rod 46 to position 50*b* at the upper end 56 of the threaded rod 46 as illustrated in FIG. 1. When the members 50, 50' are in position 50*b* the ladder 60 is stored substantially above the upper floor 24 in position 60*c*. With the ladder in position 60*c* a hinged access door 26 may be lowered to close the upper floor 24** away from the lower floor 22. The access door 26 may be operated by a cable and pulley means 28.

It will be understood by one skilled in the art that the reversible motor means 44 is activated by closing a single electrical activation switch 80 which is located adjacent the lower floor 22. The garage door opener 40 contains limit switches (not shown) that cause, by reversing the motor means 44, the threaded nut 48 and the hook shaped members 50, 50' to move away, in FIG. 1, from position 50*a* to position 50*b* and from position 50*b* to position 50*a* when the activation switch 80 is closed (the activation switch 80 is spring biased to open after being temporarily closed). For example, if the hook shaped members 50, 50' are initially in position 50*a*, they will travel, after the activation switch 80 is closed, the position 50*b*. If the activation switch 80 is again closed they will return to position 50*a*.

The activation switch 80 is connected in series with the motor means 44 and safety switch 81. The safety switch 81 is mechanically closed by the access door 26 which abuts it when the access door 26 is in the open position 26*a* as shown in FIG. 1. Thus the ladder apparatus 30 may be operated only when the access door 26 is open.

In FIG. 1 a pair of L shaped frames 86, 86', which are also shown in FIG. 2, support rollers 88, 88' upon which the ladder 60 may easily move. The frames 88, 88' may be attached to the structure 20 by any means well known in the art. It may be appreciated from FIG. 1 that the garage door opener 40 may be installed at a very low angle 42 and thus the ladder apparatus 30 may be used where the available headroom above the upper floor 24 is minimal. This feature results from the fact that the angle 42 does not affect the position 60*b* in which the ladder 60 is used for access to the upper floor 24. It should also be understood that the ladder 60 may be removed from the ladder apparatus 30 and used elsewhere as desired. The garage door opener 40 is but one embodiment of that portion of the current invention that moves the ladder 60 and its function may be performed by any equivalent apparatus.

Figure 3:
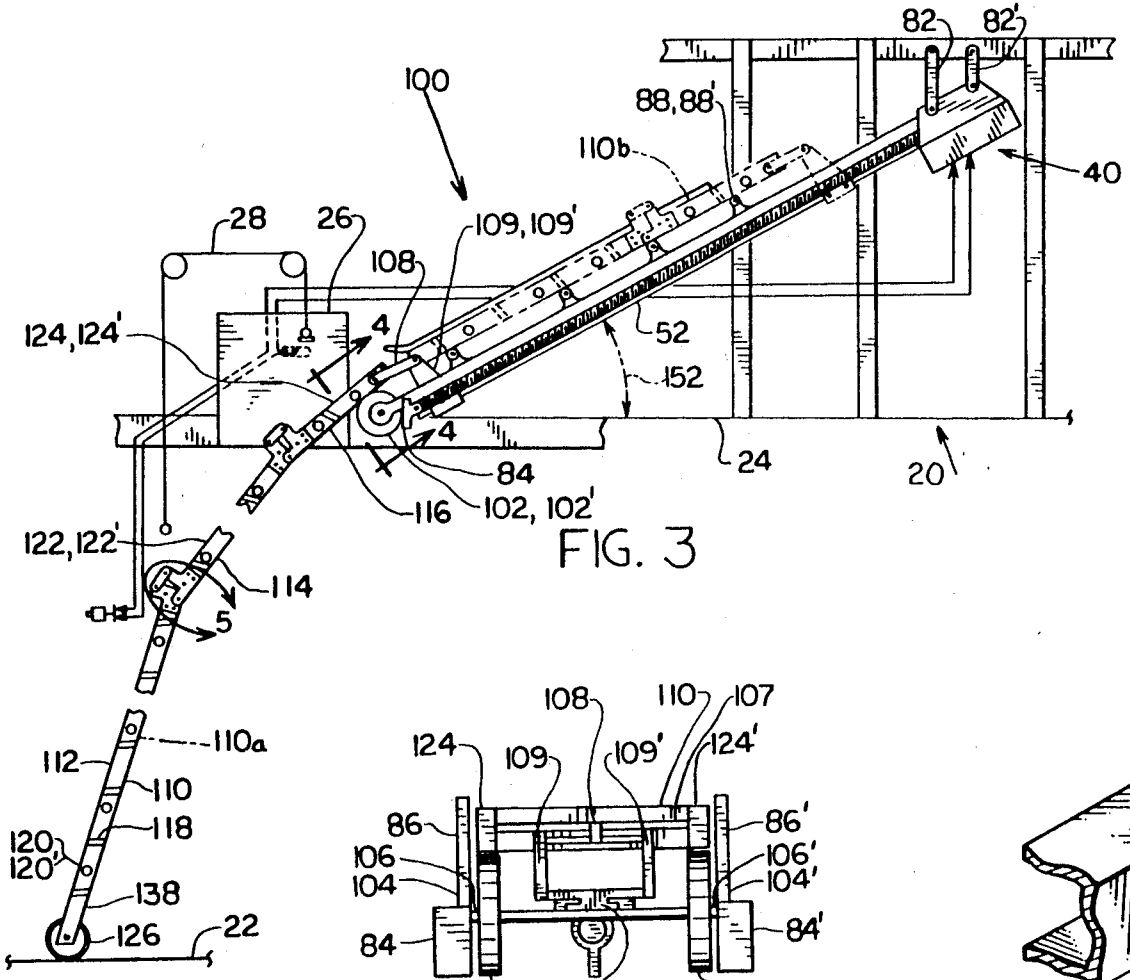
FIG. 3 is a sectional elevationa view, in accordance with another embodiment of the present invention, of a retractable ladder apparatus.

FIG. 3 is a view similar to FIG. 1 and illustrates, in accordance with another emboidment of the current invention, a ladder apparatus 100 installed in a structure 20 to provide access between a lower floor 22 and an upper floor 24. The ladder apparatus 100 has an articulated ladder 110 which has sections 112, 114 and 116. Each section 112, 114 and 116 is constructed of a pair of sidepieces 120, 120', 122, 122' and 124, 124'0 respectively and a plurality of rungs 118. A wheel 126 supports the lower end 138 of the ladder 110 when it is position 110*a* abutting the lower floor 22.

Figure 4:
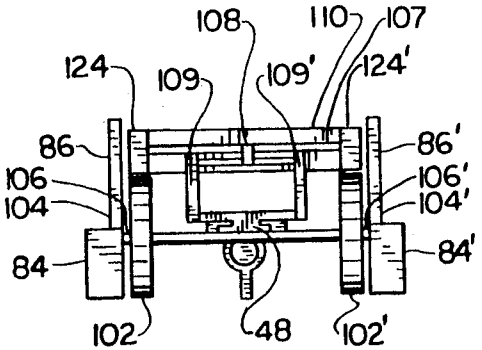
FIG. 4 is a view along the line 4—4 of FIG. 3.

FIG. 4 is a view along the line 4—4 illustrating a pair of end rollers 102, 102' that support the articulated ladder 110 as it comes off the end of the frames 86, 86'. The end rollers 10, 102' are mounted to the frames 86, 86' with plates 104, 104' and spacers 106, 106'. The sidepieces 124, 124' have a pin 107 between them which is connected by a joiner 108 to gussets 109, 109'. The gussets 109, 109' are attached to the threaded nut 48 similar to the attachment of the members 50, 50' in FIG. 2. The joiner 108 and the gussets 109, 109' act as a carrier which connects the traveling threaded nut 48 and the articulated ladder 110. The pin 107 through a hole in one end of the joiner 108 and conventional hardware is used at the other end to attach the joiner 108 to gussets 109, 109'. The connection at each end of the joiner 108 allows it to rotate relative t the other parts.

The garage door opener can thus move the articulated ladder 110 between the position 110*a* and the position 110*b* where it is stored substantially above the upper floor 24. Position 110*b* for the ladder 110 is similar to the position 60*c* for the ladder 60 in FIG. 1. In addition to being supported by the pair of end rollers 102, 102', the articulated ladder 110 also moves upon smaller diameter rollers 88, 88' as in the case of the ladder 30 (FIG. 1.

Figure 5:
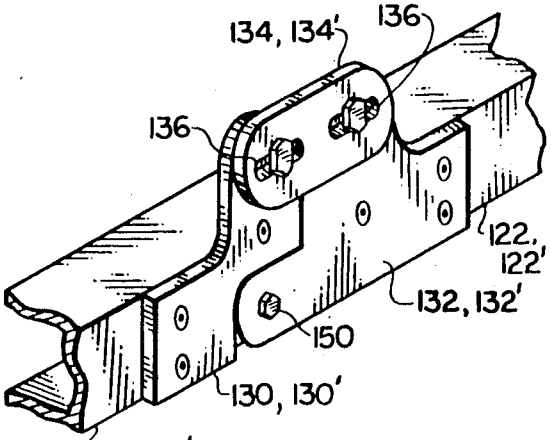
FIG. 5 is a view of the area enclosed by the line 5—5 of FIG. 3.

FIG. 5 is a view of the area within the line 5—5 of FIG. 3 and illustrates an articulated joint of the ladder 110. The two sidepieces 120, 120' of ladder section 112 terminate in first ears 130, 130' while the sidepieces 122, 122' of ladder section 114 terminate in second ears 132, 132'. The first and second ears 130, 132 are rotatably joined by a bolt 150 at their lower portions while a link 134 joins their upper sections. The link 134 has a slot 136 at each end which allows movement between the upper portions of the first and second ears 130, 132. Thus the articulated ladder 110 may bend and drop to abut the lower floor 22 as it rolls over the end rollers 102, 102' (FIG. 3). The flexibility aforded by the joiner 108 also allows the ladder 110 to adjust its position as it drops to abut the lower floor 22. This articulation allows an installation of the garage door opener 40 with a smaller angle 152 between the garage door opener 40 and the upper floor 24 than if the ladder 110 were solid. Thus the ladder apparatus 100 may be used in an upper floor 24 that has limited headroom.

The present invention, as shown in the embodiments of ladder apparatus 30 and ladder apparatus 100, provides access between a lower and an upper floor 22, 24 with the use of a simple apparatus that is easily mounted in a structure 20, especially one in which the upper floor 24 headroom is minimal.

Although the present invention has been described with reference to preferred embodiments, numerous modifications and rearrangements can be made with the equivalent result still embraced within the scope of the invention.

What is claimed is:

1. A ladder apparatus providing access between a lower floor and an upper floor, comprising:

a carrier;

reversible moving means to move said carrier;

a ladder removably connected to said carrier, said ladder having a lower end; and support means for said ladder to move thereon;

said ladder thereby movable on said support means between a position where said ladder is substantially contained within the upper floor and a position where said lower end abuts the lower floor, said ladder adjustable on and removable from said carrier.

2. A ladder apparatus as defined in claim 1 wherein said moving means comprises:

reversibe electrical motor means; and drive means cooperative with said motor means for moving said carrier.

3. A ladder apparatus as defined in claim 2 wherein said drive means comprises:

a threaded rod turned by said motor means; and a threaded nut on said rod and mounted to said carrier whereby said nut and said carrier travel along said rod when said rod is turned by said motor means.

4. A ladder apparatus as defined in claim 1 wherein said moving means comprises a garage door opener of the type having a reversible motor, a threaded rod turned by the motor and a threaded nut traveling along the rod; said carrier mounted on said nut.

5. A ladder apparatus as defined in claim 1 wherein said carrier comprises a hook shaped member and said ladder is removably connected by placing upper rung of said ladder over said member.

6. A ladder apparatus as defined in claim 1 wherein said support means comprises a plurality of rollers along which said ladder rolls.

7. A ladder apparatus as defined in claim 2 further comprising electrical switch means in series with said motor mens, said switch means closed by mechanical motion of opening an access door between the upper and lower floors through which said ladder may be moved, said motor means thereby operable only if access door is open.

8. A ladder apparatus as defined in claim 7 wherein said drive means comprises:

a threaded rod turned by said motor means; and a threaded nut on said rod and mounted to said carrier whereby said nut and said carrier travel along rod when said rod is turned by said motor means.

9. A ladder apparatus as defined in claim 8 wherein said carrier comprises a hook shaped member and said ladder is removably connected by placing upper rung of said ladder over said member.

10. A ladder apparatus as defined in claim 9 wherein said support means comprises a plurality of rollers along which said ladder rolls.

11. A ladder apparatus providing access between a lower floor and an upper floor, comprising:

a carrier;

reversible moving means to move said carrier;

an articulated ladder rotatably connected to said carrier, said ladder having a lower end; and support means for said ladder to move thereon;

said ladder is substantially contained within the upper floor and a position where said lower end abuts the lower floor;

said ladder articulation minimizing the height required for said apparatus within the upper floor.

12. A ladder apparatus as defined in claim 11 wherein said moving means comprises:

reversible electrical means; and drive means cooperative with said motor means.

13. A ladder apparatus as defined in claim 12 wherein said drive means comprises:

a threaded rod turned by said motor means; and a threaded nut on said rod mounted to said carrier whereby said nut and said carrier travel along said rod when said rod turned by said motor means.

14. A ladder apparatus as defined in claim 11 wherein moving means comprises a garage door opener of the type having a reversible motor, a threaded rod turned by the motor and a threaded nut traveling along the rod; said carrier mounted on said nut.

15. A ladder apparatus as defined in claim 11 wherein said support means comprises a plurality of rollers along which said ladder rolls.

16. A ladder apparatus as defined in claim 12 further comprising electrical switch means in series with said motor means and closed by mechanical motion of opening an access door between the upper and lower floors through which said ladder may be moved, said motor means thereby operable only if access door is open.

17. A ladder apparatus as defined in claim 16 wherein said drive means comprises:

a threaded rod turned by said motor; means and a threaded nut on said rod and mounted to said carrier whereby said nut and said carroer travel along said rod when said rod is turned by said motor means.

18. A ladder apparatus as defined in claim 17 wherein said support means comprises a pluralty of rollers along which said ladder rolls.

19. A method of using a ladder apparatus providing access between a lower and an upper floor where the apparatus has reversible motor means controlled by a safety switch and an actuator switch in series, the motor means moving a ladder via dirve means, the method comprising:

opening the access door between the upper and lower floors thereby closing the safety switch to enable the reversible motor means;

closing the actuator switch thereby energizing the reversible motor means and moving the articulated ladder via the drive means to a position where the ladder is adjacent the lower floor;

using the ladder for access between the lower and upper floors; closing the operating switch thereby energizing the reversible motor means and moving the ladder via the drive means to a position where the ladder is substantially enclosed within the upper floor; and closing the access door between the upper and lower floors.

* * * * *